US010913143B2

(12) United States Patent
Chang et al.

(10) Patent No.: US 10,913,143 B2
(45) Date of Patent: Feb. 9, 2021

(54) HANDGRIP STRUCTURE OF HAND TOOL

(71) Applicant: YIH CHENG FACTORY CO., LTD., Nantuo (TW)

(72) Inventors: Yun-Bai Chang, Nantuo (TW); His-Hsing Wu, Nantuo (TW)

(73) Assignee: YIH CHENG FACTORY CO., LTD., Nantuo (TW)

( * ) Notice: Subject to any disclaimer, the term of this patent is extended or adjusted under 35 U.S.C. 154(b) by 248 days.

(21) Appl. No.: 16/154,721

(22) Filed: Oct. 9, 2018

(65) Prior Publication Data

US 2020/0108495 A1 Apr. 9, 2020

(51) Int. Cl.

| | |
|---|---|
| ***B25G 1/08*** | (2006.01) |
| ***B25B 23/16*** | (2006.01) |
| *B25B 23/00* | (2006.01) |

(52) U.S. Cl.

CPC ..... *B25G 1/085* (2013.01); *B25B 23/16* (2013.01); *B25B 23/0035* (2013.01)

(58) Field of Classification Search

CPC ..... B25G 1/085; B25G 1/08; B25G 1/066; B25B 15/02; B25B 23/16; B25B 23/0035; B25B 13/56; B25B 15/008; B25F 1/02; B25F 1/04; B25F 5/029

See application file for complete search history.

(56) References Cited

U.S. PATENT DOCUMENTS

| | | | | |
|---|---|---|---|---|
| 1,559,097 A * | 10/1925 | Hill | B25B 15/04 | 81/177.2 |
| 5,802,936 A * | 9/1998 | Liu | B25B 13/56 | 81/177.4 |
| 6,308,599 B1 * | 10/2001 | Fu-Hui | B25G 1/066 | 81/177.4 |
| 2004/0250379 A1 * | 12/2004 | Shiao | B25G 1/085 | 16/111.1 |

* cited by examiner

*Primary Examiner* — Robert J Scruggs
(74) *Attorney, Agent, or Firm* — Chun-Ming Shih; HDLS IPR Services

(57) ABSTRACT

A handgrip structure of a hand tool includes a handgrip body, a foldable cover and an installation set; a chamber is formed in the handgrip body, and an opening is formed at one side of the chamber; the foldable cover has one end pivoted with the handgrip body and served to cover the opening, wherein a tool accommodation room is formed between the foldable cover and the chamber of the handgrip body; and the installation set is disposed on the handgrip body and arranged corresponding to another end of the foldable cover. Accordingly, a large amount of tool heads can be stably fastened and the tool heads can be easily taken out and stored, so that features of easy in operation and convenient in storage are achieved.

7 Claims, 5 Drawing Sheets

HANDGRIP STRUCTURE OF HAND TOOL

BACKGROUND OF THE INVENTION

Field of the Invention

The present invention relates to a hand tool technology, especially to a handgrip structure of hand tool.

Description of Related Art

For saving a space required for storing hand tools and increasing the multiple choices of hand tools available when in use, a conventional hand tool has gradually developed for being formed as an assembled hand tool, especially a hand tool consisted of a handgrip and tool heads with various types and specifications, so that a use can select different tool heads for being installed on the handgrip to detach or tighten a connection member.

However, in the storage operation of various tool heads, a major problem existed in the conventional assembled hand tool is that there are two types of storage means for allowing the user to select the desired tool head and to prevent the tool head from being lost, wherein one of the two types is to enable the tool heads to be disposed inside the handgrip, and the other type is to allow the tool heads to be stored in a specially-designed tool box. When the tool heads are stored in the tool box, the user has to carry both of the hand tool and the tool box, so that disadvantages of poor mobility and less flexibility are caused; when the tool heads are desired to be disposed inside the handgrip, the interior of the handgrip is required to be annularly formed with a plurality of insertion slots along the axial circumference thereof, then the tool heads are sequentially inserted in the insertion slots, when the user want to select a hand tool, the dimension and the specification of the tool head can only be determined by the size of the front end of thereof, thus a problem of selecting the wrong tool head may happen, and an additional operation of choosing a correct tool head is required; moreover, the interior of the handgrip can only store a small amount of tool heads, so that disadvantages of improper in actual use and inconvenient in operation are caused.

Accordingly, the applicant of the present invention has devoted himself for improving the mentioned disadvantages.

SUMMARY OF THE INVENTION

The present invention is to provide a handgrip structure of hand tool, which has advantages of enabling a large amount of tool heads to be stably fastened and allowing the tool heads to be easily taken out and stored via the arrangement of components, so that features of easy in operation and convenient in storage are achieved.

Accordingly, the present invention provides a handgrip structure of hand tool, which includes a handgrip body, a foldable cover and an installation set; a chamber is formed in the handgrip body, and an opening is formed at one side of the chamber; the foldable cover has one end pivoted with the handgrip body and served to cover corresponding to the opening, wherein a tool accommodation room is formed between the foldable cover and the chamber of the handgrip body; and the installation set is disposed on the handgrip body and arranged corresponding to another end of the foldable cover.

In comparison with related art, the present invention has advantageous features as follows. With the installation set being disposed at a top part of the handgrip body, the foldable cover can be folded or unfolded with single hand of a user, thereby increasing the operation convenience; and with the installation of a torsion spring, the foldable cover can be rapidly unfolded after the foldable cover is released.

DETAILED DESCRIPTION OF THE INVENTION

A preferred embodiment of the present invention will be described with reference to the drawings.

Figure 1:
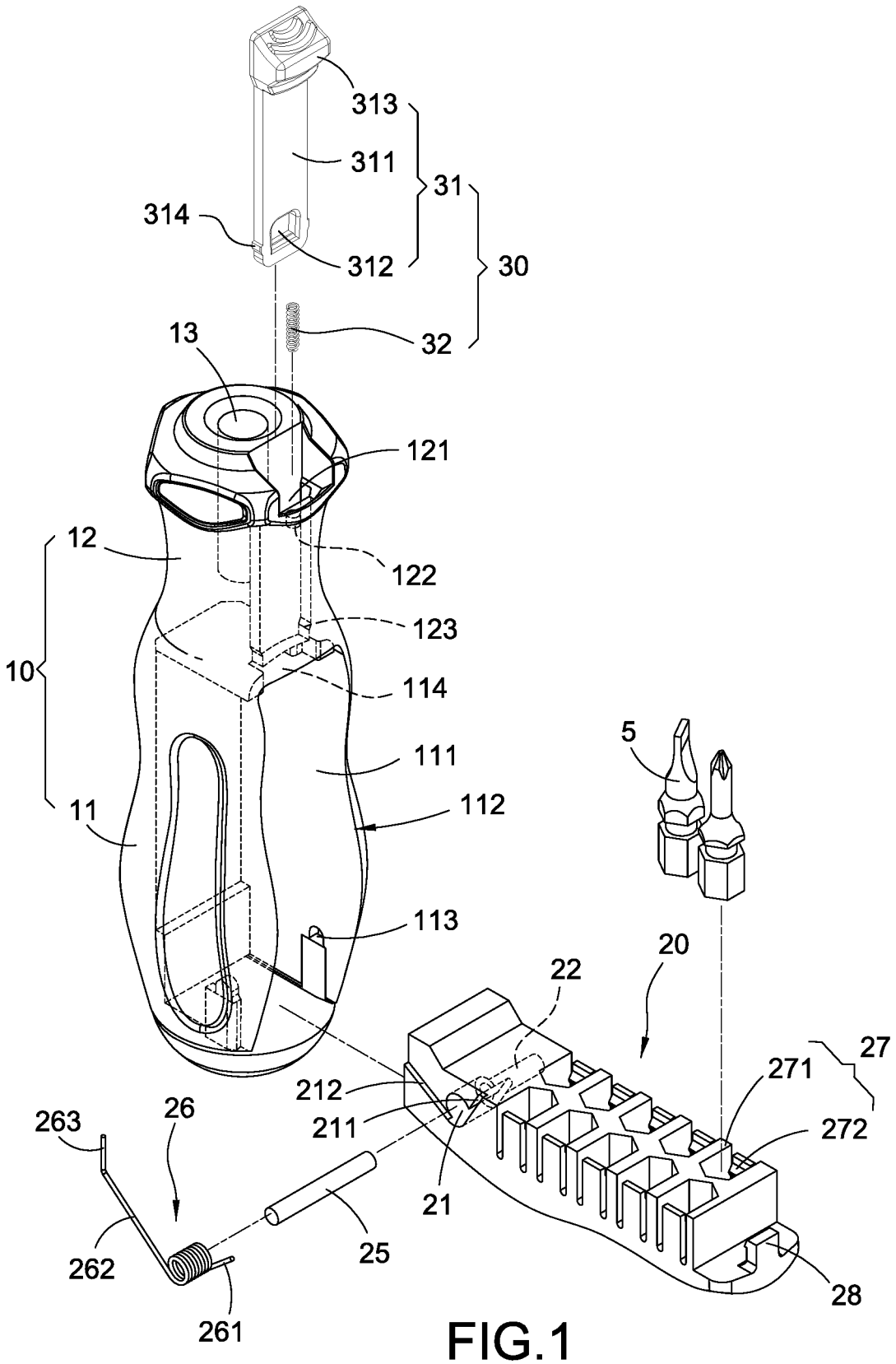
FIG. 1 is a perspective exploded view showing a handgrip structure of hand tool according to the present invention.
Figure 2:
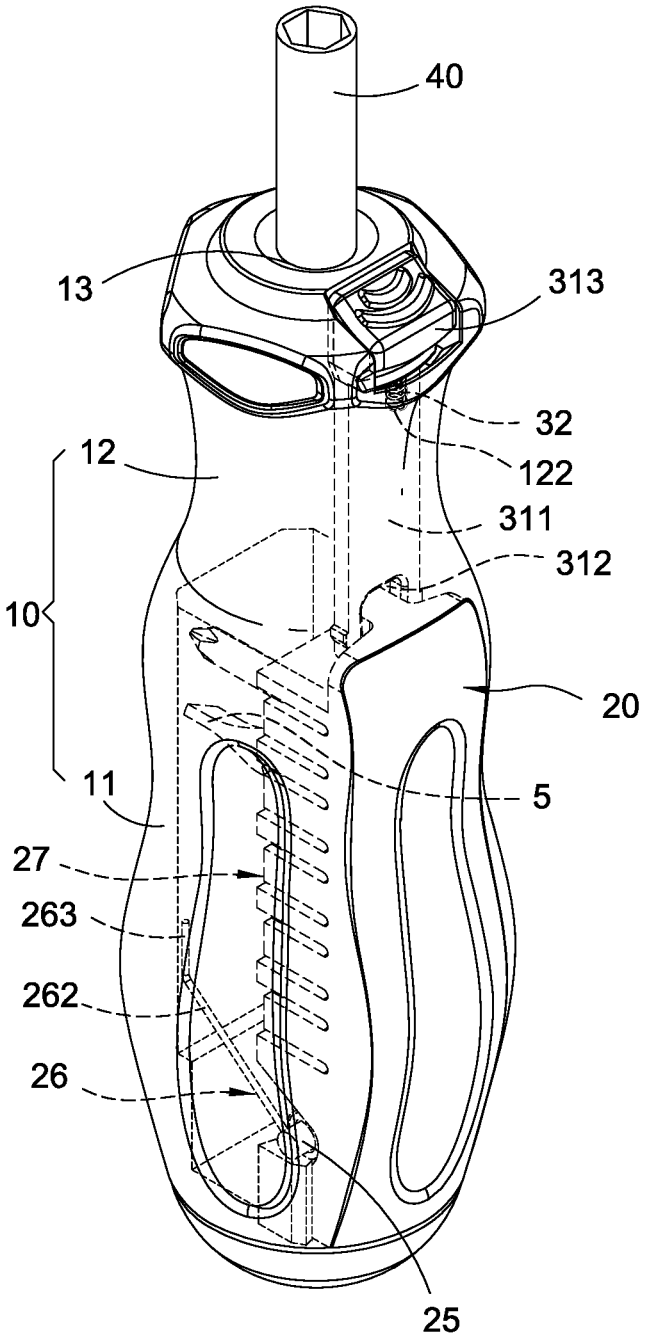
FIG. 2 is a schematic view showing the assembly of the handgrip structure of hand tool according to the present invention.
Figure 3:
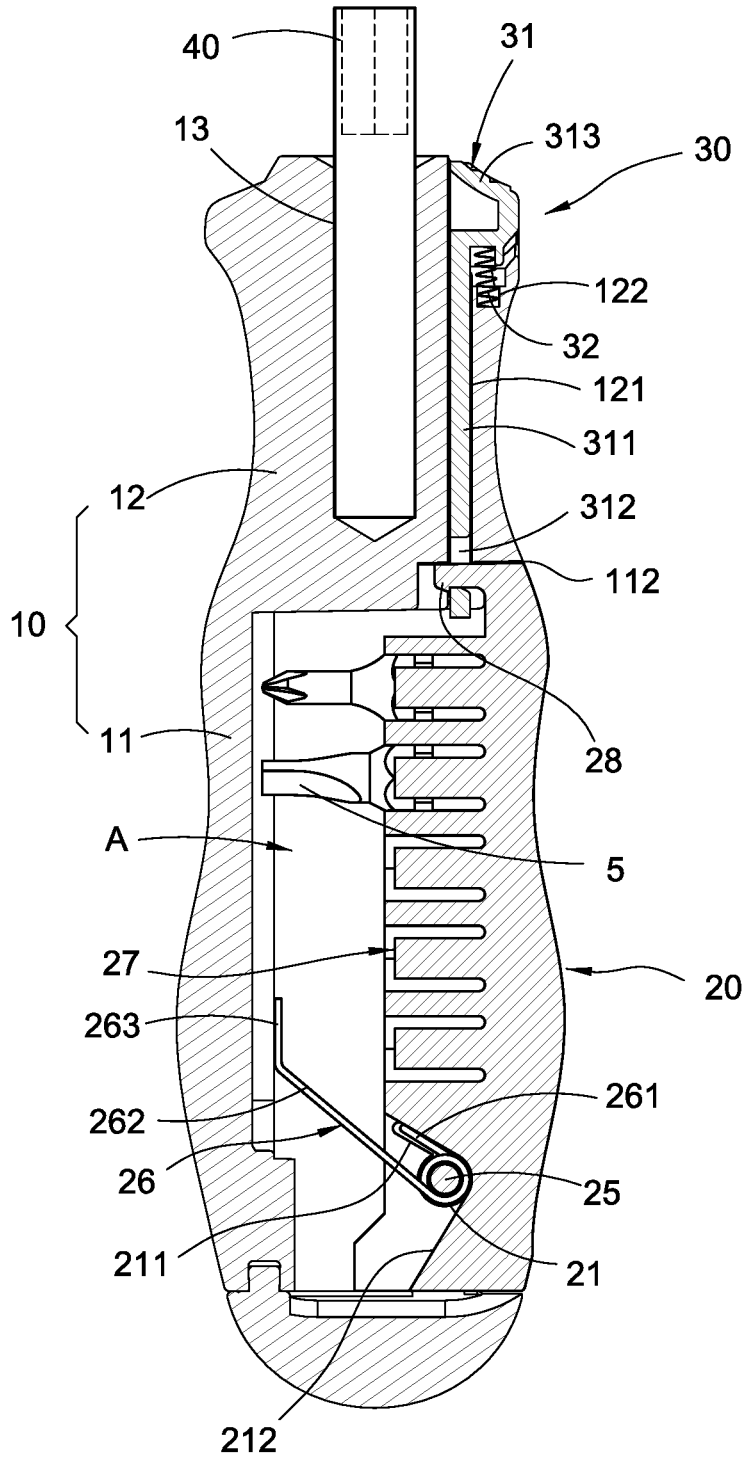
FIG. 3 is a cross sectional view showing the assembly of the handgrip structure of hand tool according to the present invention.

Please refer from FIG. 1 to FIG. 3, the present invention provides a handgrip structure of hand tool, which mainly includes a handgrip body 10, a foldable cover 20 and an installation set 30.

The handgrip body 10 mainly has a handheld part 11 and a top part 12 upwardly extended from the handheld part 11. A chamber 111 is formed at one side of the handheld part 11, and an opening 112 is formed at one side of the chamber 111. A shaft connection hole 113 is formed on the handgrip body 10 and located at a lower portion of the chamber 111, and a connection slot 114 communicated with the chamber 111 is formed on the handgrip body 10 and located at an upper portion of the chamber 111. An insertion slot 121 is formed on a distal surface of the top part 12 and communicated with the connection slot 114. A spring receiving slot 122 is formed on the top part 12 and located at an outer side of the insertion slot 121, and a pair of blocks 123 are provided at a lower portion of the insertion slot 121 and located at an area close to the connection slot 114. A pipe connection hole is formed at a central location defined on a top distal surface of the top part 12.

The foldable cover 20 has one end pivoted at a bottom end of the handgrip body 10 and served to cover corresponding to the opening 112, and a tool accommodation room A is formed between the foldable cover 20 and the chamber 111 of the handgrip body 10.

According to this embodiment, the foldable cover 20 is substantially formed as a long rectangular member, but what shall be addressed is that the scope of the present invention is not limited to the above-mentioned long rectangular shape. A torsion spring receiving slot 21 and a shaft hole 22 communicated with the torsion spring receiving slot 21 are formed at a lower portion of the foldable cover 20, and a support arm receiving slot 211 communicated with the torsion spring receiving slot 21 and a support arm blocking edge 212 are respectively formed at lateral edges of the torsion spring receiving slot 21.

The shaft hole 22 allows a shaft rod 25 to be disposed therein, and a portion of the shaft rod 25 exposed outside the shaft hole 22 is received in the shaft connection hole 113, so that one end of the foldable cover 20 and the handgrip body 10 can be pivotally connected.

The torsion spring receiving slot 21 is provided for allowing a torsion spring 26 to be received and fastened. The torsions spring 26 has a first support arm 261 and a second support arm 262, and a distal end of the second support arm 262 is extended with an abutting part 263. Wherein, the first support arm 261 is mounted corresponding to the support arm receiving slot 211, the second support arm 262 is abutted corresponding to the support arm blocking edge 212, the abutting part 263 is exposed outside the support arm blocking edge 212, and the center of the torsion spring 26 is sleeved at one end of the shaft rod 25.

The tool accommodation room A includes a plurality of insertion seats 27. The insertion seats 27 can be disposed in the chamber 111 of the handgrip body 10; according to this embodiment, the insertion seats 27 can also be disposed inside the foldable cover 20. Each insertion seat 27 mainly has a U-shaped holding plate 271 and a buckle piece 272 disposed corresponding to an opened side of the U-shaped holding plate 271, thereby allowing various types of tool heads 5 (for example a flat screwdriver, a cross screwdriver or a socket) to be disposed. Moreover, a hook 28 is formed at an upper portion of the foldable cover 20.

The installation set 30 is disposed at the top part 12 of the handgrip body 10 and arranged corresponding to another end of the foldable cover 20. According to this embodiment, the installation set 30 mainly has a moveable unit 31 and a spring 32. The moveable unit 31 has a sheet member 311 and a cap member 313 connected to a distal end of the sheet member 311. A hook slot 312 is formed at a lower portion of the sheet member 311, and a pair of protrusions 314 are extended from outer sides of the sheet member 311 and arranged corresponding to the location of the hook slot 312. Wherein, the sheet member 311 of the moveable unit 31 is inserted in the insertion slot 121, and the sheet member 311 is able to be positioned in the insertion slot 121 through a mutual blocking and restraining effect formed by each protrusion 314 and each block 123. The spring 32 is disposed corresponding to the spring receiving slot 122 and served to elastically push the cap member 313.

According to the present invention, the handgrip structure of hand tool further includes a connection pipe 40. The connection pipe 40 is inserted corresponding to the pipe connection hole 13 so as to be connected, thereby enabling the various tool heads 5 to be installed or replaced.

Figure 4:
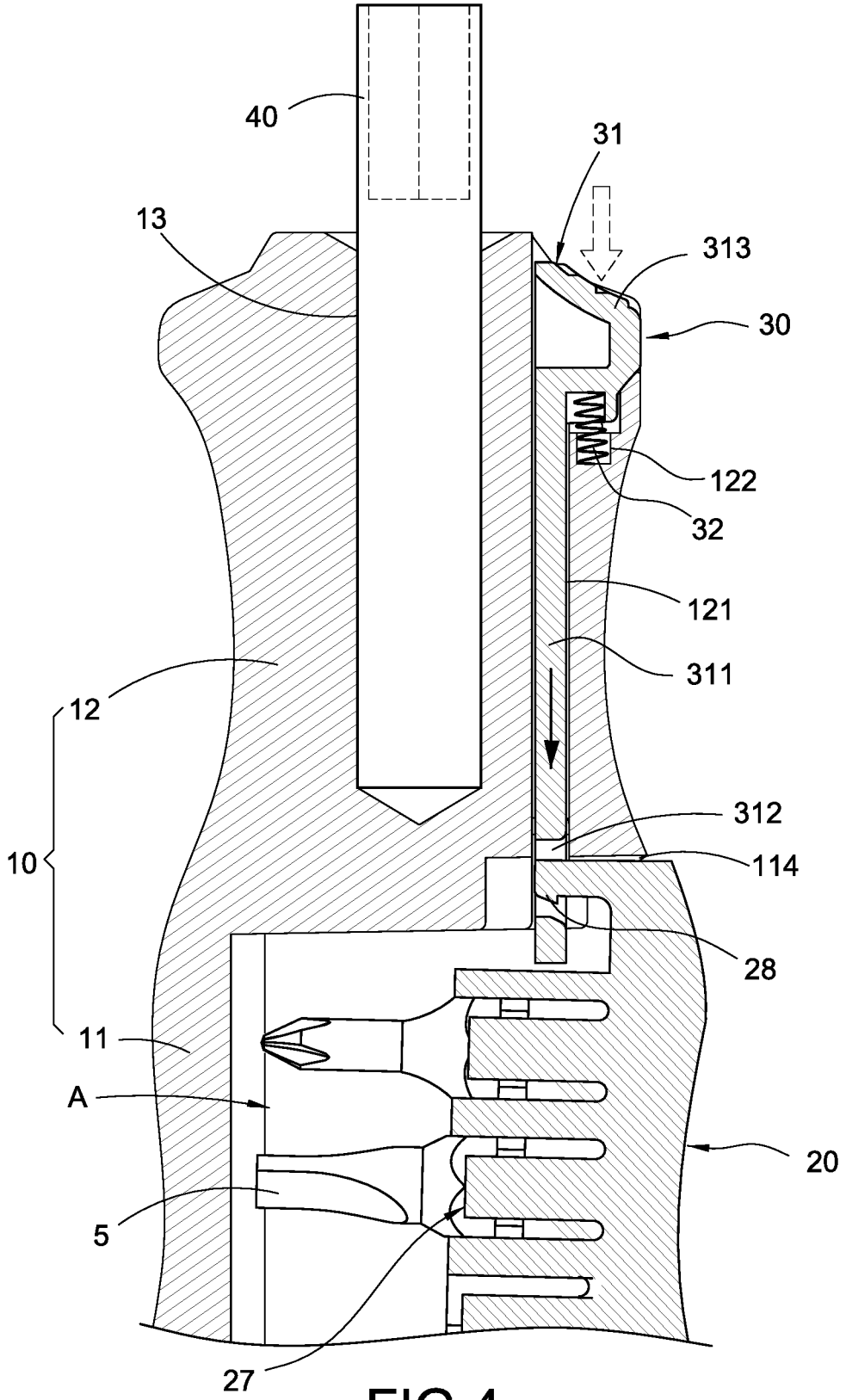
FIG. 4 is a cross sectional view showing an operating status of the handgrip structure of hand tool according to the present invention.
Figure 5:
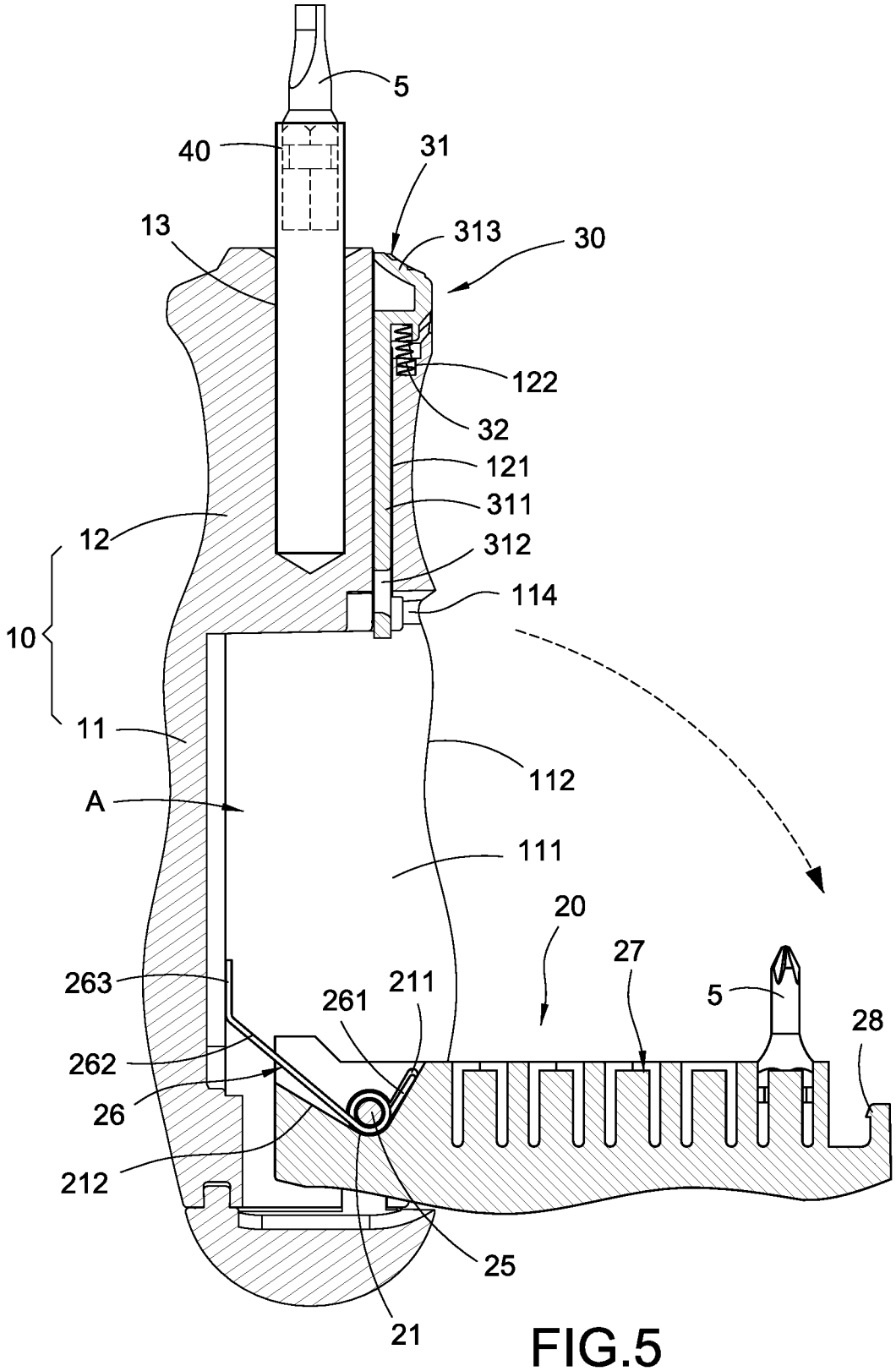
FIG. 5 is a cross sectional view showing another operating status of the handgrip structure of hand tool according to the present invention.

Please refer to FIG. 4 and FIG. 5, when being in an operating status, the handheld part 11 of the handgrip body 10 is held by the palm and four fingers of a single hand of a user, and the top part 12 is held by the thumb of the user; when being in another operating status, the cap member 313 of the moveable unit 31 is downwardly pressed by the thumb of the same single hand, the abutting part 263 of the torsion spring 26 is elastically abutted against an inner wall of the chamber 111, and the first support arm 261 is received in the support arm receiving slot 211, so that a preset upwardly-unfolding torque is provided to the foldable cover 20, when the sheet member 311 and the hook slot 312 are pushed to be downwardly displaced, the hook 28 is able to be released from the hook slot 312, thereby enabling the foldable cover 20 to upwardly unfold with the shaft rod 25 served as a rotation center; and then, the desired tool head 5 is selected by another hand of the user for being inserted corresponding to the connection pipe 40 for the purpose of operation.

Based on what has been disclosed above, the handgrip structure of hand tool provided by the present invention is novel and more practical in use comparing to prior arts.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A handgrip structure of hand tool, including:

a handgrip body formed with a chamber, wherein an opening is formed at one side of the chamber;

a foldable cover having one end pivoted with the handgrip body and served to cover the opening, wherein a tool accommodation room is formed between the foldable cover and the chamber of the handgrip body; and an installation set disposed on the handgrip body and arranged corresponding to another end of the foldable cover, wherein the handgrip body has a handheld part and a top part extended from the handheld part, the chamber is formed inside the handheld part, and the installation set is disposed on the top part;

wherein the installation set has a moveable unit and a spring, the moveable unit has a sheet member and a cap member connected to the sheet member, an insertion slot is formed at the top part, a spring receiving slot is formed on the top part and located at an outer side of the insertion slot, the sheet member is inserted in the insertion slot, and the spring is received in the spring receiving slot and served to elastically push the cap member;

wherein the sheet member is formed with a hook slot, and outer sides of the sheet member corresponding to the hook slot are extended with a pair of protrusions, the foldable cover is formed with a hook, the hook is hooked and buckled corresponding to the hook slot, a pair of blocks are formed at a lower portion of the insertion slot, and each block is used for restraining a displacement range of each one of the pair of protrusions, respectively.

2. The handgrip structure of hand tool according to claim 1, wherein the handgrip body is formed with a shaft connection hole, the foldable cover is formed with a shaft hole, a shaft rod is provided for penetrating the shaft hole and the shaft connection hole, so that the foldable cover and the handgrip body are able to be pivotally connected.

3. The handgrip structure of hand tool according to claim 2, wherein the foldable cover is formed with a torsion spring receiving slot communicated with the shaft hole, and a torsion spring is sleeved on the shaft rod and received in the torsion spring receiving slot.

4. The handgrip structure of hand tool according to claim 3, wherein a support arm receiving slot communicated with the torsion spring receiving slot and a support arm blocking edge are respectively formed on the foldable cover and located at lateral edges of the torsion spring receiving slot, the torsions spring has a first support arm and a second support arm, the first support arm is mounted corresponding to the support arm receiving slot, and the second support arm is abutted corresponding to the support arm blocking edge.

5. The handgrip structure of hand tool according to claim 4, wherein a distal end of the second support arm is extended with an abutting part, the abutting part is exposed outside the support arm blocking edge, and elastically abutted against an inner wall of the chamber.

6. The handgrip structure of hand tool according to claim 1, wherein the tool accommodation room includes a plurality of insertion seats, and the insertion seat is formed inside the foldable cover.

7. The handgrip structure of hand tool according to claim 6, wherein the insertion seat has a U-shaped holding plate and a buckle piece disposed corresponding to an opened side of the U-shaped holding plate.

* * * * *